US007957689B2

(12) United States Patent
Nobe et al.

(10) Patent No.: US 7,957,689 B2
(45) Date of Patent: Jun. 7, 2011

(54) IMAGE FORMING APPARATUS

(75) Inventors: Hiroshi Nobe, Nagoya (JP); Sakae Ito, Nishikasugai-gun (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 12/186,989

(22) Filed: Aug. 6, 2008

(65) Prior Publication Data

US 2008/0304886 A1 Dec. 11, 2008

Related U.S. Application Data

(63) Continuation of application No. 11/187,795, filed on Jul. 25, 2005, now Pat. No. 7,463,860.

(30) Foreign Application Priority Data

Jul. 26, 2004 (JP) ..... 2004-217653

(51) Int. Cl.
*G03G 15/00* (2006.01)

(52) U.S. Cl. ..... 399/405; 399/25; 399/114

(58) Field of Classification Search ..... 399/405, 399/25, 114

See application file for complete search history.

(56) References Cited

U.S. PATENT DOCUMENTS

| | | | | |
|---|---|---|---|---|
| 5,111,252 | A | 5/1992 | Hamada et al. | |
| 7,463,860 | B2 * | 12/2008 | Nobe et al. | 399/405 |
| 2002/0056957 | A1 | 5/2002 | Sekine | |
| 2003/0016401 | A1 | 1/2003 | Saito | |
| 2003/0049036 | A1 | 3/2003 | Ueno et al. | |
| 2004/0062583 | A1 * | 4/2004 | Kameyama et al. | 399/405 |

FOREIGN PATENT DOCUMENTS

| | | |
|---|---|---|
| JP | 06-271170 | 9/1994 |
| JP | 08-179675 | 7/1996 |
| JP | 09-020445 A | 1/1997 |
| JP | 10-167547 | 6/1998 |
| JP | 11-079540 A | 3/1999 |
| JP | 11-157724 A | 6/1999 |
| JP | 2001-063902 A | 3/2001 |
| JP | 2002-104694 | 4/2002 |
| JP | 2003-201054 A | 7/2003 |

OTHER PUBLICATIONS

Notification of Reason for Refusal dispatched Mar. 18, 2008 in Japanese Application No. 2004-217653 and English translation thereof.

Office Action in corresponding Chinese Application No. 2005-00884520 Jul. 11, 2008.

Translation of Chinese Office Action, Application No. 2005100884520, Dated Jul. 11, 2008.

Office Action for Japanese Application No. 2004-217653 mailed Jul. 17, 2009.

* cited by examiner

*Primary Examiner* — Ren Yan
*Assistant Examiner* — Andy L Pham
(74) *Attorney, Agent, or Firm* — Banner & Witcoff, Ltd.

(57) ABSTRACT

An image-forming apparatus includes a body casing having on upper surface thereof a paper ejection tray on which a sheet of paper ejected after formation of an image is stacked; a side cover capable of opening and closing a side surface of the body casing on the downstream side in the direction of ejection of the sheet of paper so as to cover the side surface of the body casing; and an extension tray being attached to an upper portion of the side cover. The extension tray is capable of extending to the downstream side in the direction of ejection of the sheet of paper with respect to the paper ejection tray so as to support an end portion of the sheet of paper.

19 Claims, 9 Drawing Sheets

IMAGE FORMING APPARATUS

CROSS-REFERENCE TO RELATED APPLICATIONS

This application is a continuation of U.S. patent application Ser. No. 11/187,795, filed Jul. 25, 2005, which is based upon and claims the benefit of priority from prior Japanese Patent Application No. 2004-217653, filed Jul. 26, 2004, the entire contents of which are incorporated herein by reference

BACKGROUND OF THE INVENTION

1. Field of the Invention

The present invention relates to an image forming apparatus such as a printer, a copying machine, a facsimile machine, etc.

2. Description of the Related Art

As an image forming apparatus such as a printer, there has been heretofore known an image forming apparatus having a paper ejection tray which is formed on an upper surface of a body casing so that a sheet of paper ejected after formation of an image can be stacked on the paper ejection tray. For example, in this type image forming apparatus described in JP-A-2002-104694, an extension tray for receiving a large-size sheet of paper is attached to the upper surface of the body casing. In use, the extension tray is fixed with a posture extending to the downstream side in the direction of ejection of the sheet of paper with respect to the paper ejection tray so that the movement of the sheet of paper in the direction of ejection of the sheet of paper is limited while a front end of the large-size sheet of paper ejected on the paper ejection tray is supported.

SUMMARY OF THE INVENTION

According to the above-related art, when the image forming apparatus having the extension tray is designed so that the size of the body casing is reduced in accordance with the demand on reduction in size, it is necessary to enlarge the length of the extension tray so that the maximum paper size allowed to be loaded does not change. For this reason, a problem to increase in the cost of parts is caused.

It is an object of the invention to provide an image forming apparatus in which reduction in size of an extension tray can be attained.

(1) According to one aspect of the invention, there is provided an image-forming apparatus includes a body casing having on upper surface thereof a paper ejection tray on which a sheet of paper ejected after formation of an image is stacked; a side cover capable of opening and closing a side surface of the body casing on the downstream side in the direction of ejection of the sheet of paper so as to cover the side surface of the body casing; and an extension tray being attached to an upper portion of the side cover. The extension tray is capable of extending to the downstream side in the direction of ejection of the sheet of paper with respect to the paper ejection tray so as to support an end portion of the sheet of paper. Because the extension tray is attached to the side cover which covers the side surface of the body casing on the downstream side in the direction of ejection of the sheet of paper so that the side cover can be opened/closed, the length of the extension tray can be reduced compared with the case where the extension tray is provided on the body casing side so that reduction in cost can be attained.

(2) According to another aspect of the invention, the image forming apparatus further includes a rib. The rib is on upper surface of the side cover. The rib protrudes along the direction of ejection of the sheet of paper. The rib has upper end surface which is substantially smoothly connected to an upper surface of the paper ejection tray. Because the upper end surfaces of the ribs provided on the upper surface of the side cover are formed to be substantially smoothly connected to the upper surface of the paper ejection tray, the front end portion of the sheet of paper ejected onto the paper ejection tray can be put on the ribs so that the sheet of paper can be taken out easily.

(3) According to another aspect of the invention, the rib has at least one pair of ribs on both sides in the widthwise direction of the extension tray. At least one pair of ribs is disposed to be spatially separated from the extension tray. Because the pair of ribs provided on widthwise opposite sides with respect to the extension tray are disposed at a distance from the extension tray, the sheet of paper can be taken out easily without any obstruction caused by the extension tray when the sheet of paper having the front end portion put on the ribs needs to be taken out.

(4) According to another aspect of the invention, an inclined surface is formed on an end portion of upper surface of the side cover on a downstream side in a direction of ejection of the sheet of paper. The inclined surface is inclined down from the upstream side to the downstream side in a direction of ejection of the sheet of paper. Because the inclined surface inclined down from the upstream side to the downstream side is formed in the end portion of the upper surface of the side cover on the downstream side in the direction of ejection of the sheet of paper, the front end of the sheet of paper floats up from the inclined surface so that the sheet of paper can be taken out easily when the front end of the sheet of paper is put on the side cover.

(5) According to another aspect of the invention, the extension tray can rotate on a rotation shaft provided near an end portion of the upper surface of the side cover on the downstream side in the direction of ejection of the sheet of paper so that the extension tray can be displaced to a use position where the extension tray extends to the downstream side in the direction of ejection of the sheet of paper and to a retraction position where the extension tray falls down to the upper surface side of the side cover when the extension tray is rotated. Because the extension tray can be rotated on the rotation shaft provided on the upper surface of the side cover and near the downstream side end portion in the direction of ejection of the sheet of paper, the length of the extension tray can be reduced greatly without change of the maximum paper size allowed to be loaded.

(6) According to another aspect of the invention, a stopper is provided between the side cover and the extension tray so that the extension tray can be kept in the use position or in the retraction position when the stopper is fitted to each other. Because the extension tray can be held in the use position or in the retraction position by the stopper provided between the side cover and the extension tray, the side cover can be opened/closed, for example, while the position of the extension tray is kept as it is.

(7) According to another aspect of the invention, the extension tray has at least one pair of substantially plate-like support members which is rotatably connected to each other. At least one pair of substantially plate-like support members can be displaced to be unfolded/folded. Because the extension tray has a pair of substantially plate-like support plates rotatably connected to each other so that the two support plates can be displaced so as to be unfolded/folded, the extension tray can be folded compactly when the extension tray is not used.

(8) According to another aspect of the invention, a document reading portion reading an image on a document is put on the body casing in a condition that a gap is formed between the document reading portion and the upper surface of the paper ejection tray. In the image forming apparatus having the document reading portion put on the body casing, increase in size of the apparatus is caused by the fact that it may be necessary to provide a large gap between the paper ejection tray and the document reading portion in order to avoid the interference of the document reading portion with the extension tray when a rotary extension tray is attached to the body casing side. On the contrary, in this configuration, the size of the extension tray can be reduced because the extension tray is attached to the side cover. Accordingly, the gap between the paper ejection tray and the document reading portion can be reduced so that reduction in size of the apparatus can be attained.

(9) According to another aspect of the invention, the body casing stores a process cartridge having an image carrier. The side cover is formed so that an upper end side of the side cover can be opened/closed around a shaft provided on a lower end side of the side cover. The process cartridge can be attached/detached through an opening portion which is formed by opening the side cover. Because the side cover is formed so that the upper end side of the side cover can be opened/closed around the shaft provided on the lower end side of the side cover, the process cartridge can be attached/detached easily.

DESCRIPTION OF THE PREFERRED EMBODIMENTS

Figure 1:
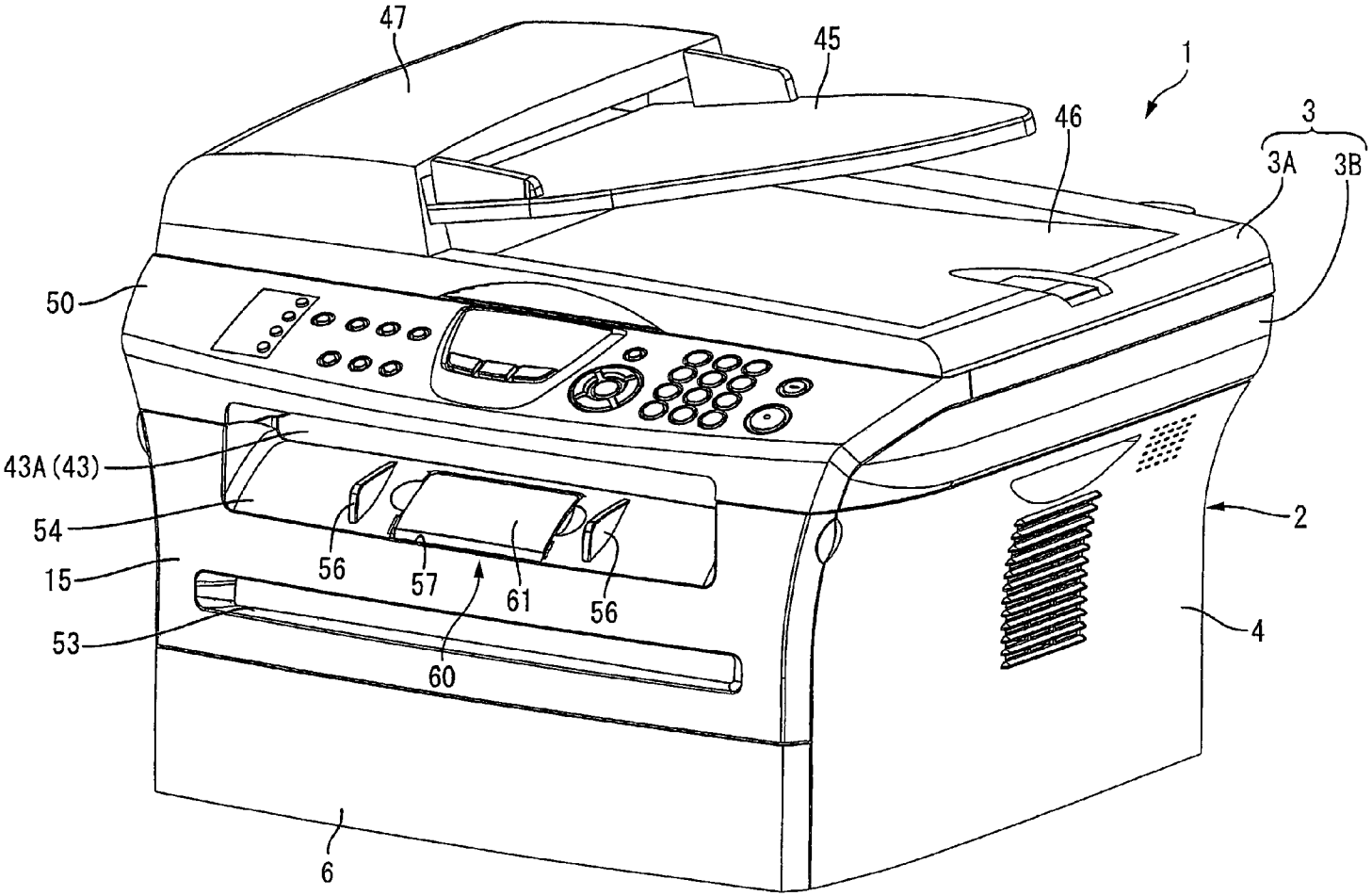
FIG. 1 is a perspective view of an image forming apparatus according to an embodiment of the invention.
Figure 2:
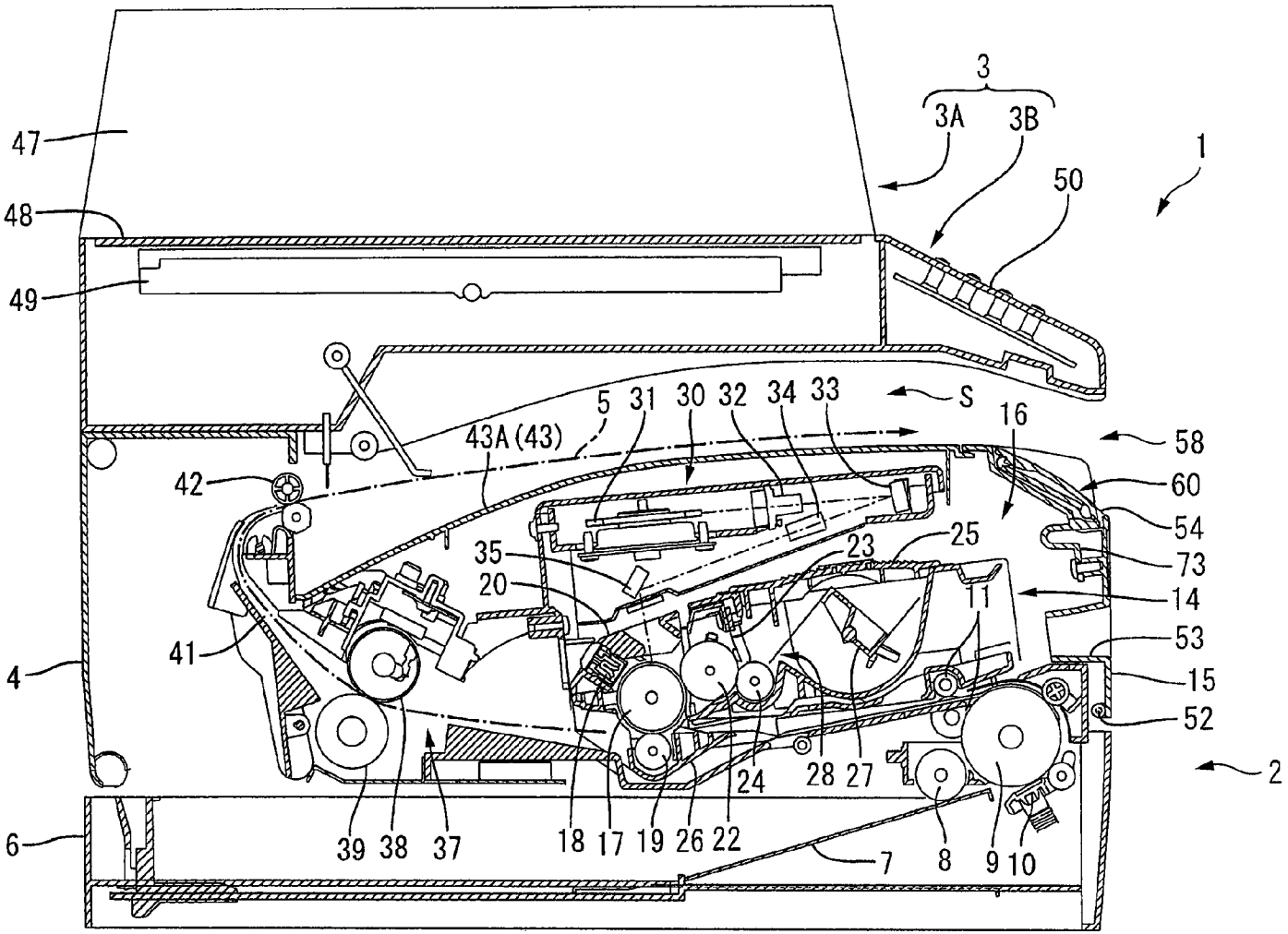
FIG. 2 is a side sectional view of the image forming apparatus.

An embodiment of the invention will be described below with reference to FIGS. 1 to 9. The overall configuration of an image forming apparatus 1 will be described first with reference to FIGS. 1 and 2. FIG. 1 is a perspective view showing the external appearance of the image forming apparatus 1. FIG. 2 is a sectional view showing important part of the image forming apparatus 1. Incidentally, in the following description, up-down directions are defined on FIG. 2 and front-rear directions are defined so that the right in FIG. 2 is regarded as "front".

The image forming apparatus 1 according to this embodiment is a combination machine including a printer function, a copying function, a scanner function, etc. The image forming apparatus 1 comprises an apparatus body 2, and a cover body 3 put on an upper surface of the apparatus body 2.

The apparatus body 2 includes a body casing 4 substantially shaped like a box as a whole. A paper feed tray 6 is provided in a lower portion of the body casing 4 so that sheets of paper 5 can be stacked like layers on the paper feed tray 6. The paper feed tray 6 can be attached/detached to/from the apparatus body 2. When the paper feed tray 6 is pulled out in front of the body casing 4, the paper feed tray 6 can be removed. A paper pressing plate 7 is provided in the paper feed tray 6 so that a front end side of the paper pressing plate 7 can be moved vertically. The paper pressing plate 7 is urged upward by a pressing spring (not shown) so that the uppermost one of the sheets of paper 5 stacked on the paper pressing plate 7 abuts on a pickup roller 8 provided above the front end portion of the paper feed tray 6. The sheets of paper 5 are conveyed toward a gap between a paper feed roller 9 and a separation pad 10 by rotation of the pickup roller 8. When the sheets of paper 5 are clamped between the paper feed roller 9 and the separation pad 10, the sheets of paper 5 are separated one by one surely. The separated sheet of paper 5 is conveyed to registration rollers 11 provided above the rear of the paper feed roller 9. The registration rollers 11 are provided as a pair of rollers. After registration, the registration rollers 11 convey the sheet of paper 5 to a transfer position which is between a photoconductor drum 17 and a transfer roller 19 (which will be described later) and where a toner image on the photoconductor drum 17 is transferred onto the sheet of paper 5.

A process cartridge 14, which can be attached/detached to/from the apparatus body 2 is provided above the paper feed tray 6. The process cartridge 14 can be attached/detached to/from the apparatus body 2 through an opening portion 16 which is formed by opening a front cover 15 (which will be described later in detail) provided as a front surface of the body casing 4.

The process cartridge 14 has a drum cartridge 20, and a development cartridge 26. The drum cartridge 20 has a photoconductor drum 17, a scorotron type charger 18, and a transfer roller 19. The development cartridge 26 has a development roller 22, a layer thickness limiting blade 23, a toner supply roller 24, and a toner box 25. The development cartridge 26 is detachably attached to the toner cartridge 20.

The toner box 25 is filled with toner (developer). The toner is agitated by rotation of an agitator 27 rotatably supported in the toner box 25 and is released from a toner supply port 28 provided in the toner box 25.

The toner supply roller 24 is rotatably disposed in the outside of the toner supply port 28. The development roller 22 is disposed opposite to the toner supply roller 24 so that the development roller 22 can rotate counterclockwise. The toner supply roller 24 has a roller made of an electrically conductive foaming material, and a roller shaft made of metal and covered with the roller. The development roller 22 has a roller made of an electrically conductive rubber material having no magnetic characteristic, and a roller shaft made of metal and covered with the roller. Incidentally, a developing bias is applied to the development roller 22.

The layer thickness limiting blade 23 is disposed near the development roller 22. The layer thickness limiting blade 23 has a blade body made of a metal plate spring material, and a pressing portion made of electrically insulating silicone rubber. The pressing portion is shaped like a semi-circle in sectional view and provided at a front end portion of the blade body. The pressing portion is formed so that the pressing portion is pressed against the development roller 22 by the elastic force of the blade body.

The toner released from the toner supply port 28 is supplied to the development roller 22 in accordance with the rotation of the toner supply roller 24. On this occasion, the toner is charged with positive electricity based on friction between the toner supply roller 24 and the development roller 22. The toner supplied onto the development roller 22 passes through between the pressing portion of the layer thickness limiting blade 23 and the development roller 22 in accordance with the rotation of the development roller 22 and is charged there with electricity sufficiently, so that the toner is carried as a thin layer having a predetermined thickness on the development roller 22.

The photoconductor drum 17 ("image carrier") is disposed opposite to the development roller 22 so that the photoconductor drum 17 can rotate clockwise. The photoconductor drum 17 has a drum body which is grounded and which has a surface portion constituted by a positively chargeable photosensitive layer made of polycarbonate or the like.

The scorotron type charger 18 is disposed at a predetermined distance from the photoconductor drum 17 so that the scorotron type charger 18 is prevented from coming into contact with the photoconductor drum 17. The scorotron type charger 18 is a positively charging scorotron type charger for generating corona discharge from a charging wire of tungsten or the like. The scorotron type charger 18 is formed so that a surface of the photoconductor drum 17 is evenly charged with electricity of positive polarity. After the surface of the photoconductor drum 17 is evenly charged with electricity of positive polarity in accordance with the rotation of the photoconductor drum 17 by the scorotron type charger 18, the surface of the photoconductor drum 17 is exposed to a laser beam emitted from a scanner portion 30 (which will be described later) by high-speed scanning of the laser beam. In this manner, an electrostatic latent image based on predetermined image data is formed.

Then, when the toner carried on the development roller 22 and charged with positive electricity is brought into contact with the photoconductor drum 17 so as to be opposite to the photoconductor drum 17 in accordance with the rotation of the development roller 22, the toner is supplied to the electrostatic latent image formed on the surface of the photoconductor drum 17, that is, on an exposure portion which is part of the surface of the photoconductor drum 17 evenly charged with positive electricity and which is exposed to the laser beam so that electric potential is lowered. In this manner, the toner is selectively carried on the exposure portion so that the electrostatic latent image on the photoconductor drum 17 is visualized. Thus, a reversal phenomenon is achieved.

The transfer roller 19 is disposed under the photoconductor drum 17 so as to be opposite to the photoconductor drum 17. The transfer roller 19 is supported by the drum cartridge 20 so as to be rotatable. The transfer roller 19 has a roller made of an ionic conductive rubber material, and a roller shaft made of metal and covered with the roller. The transfer roller 19 is formed so that a transfer bias (transfer sequence bias) is applied to the transfer roller 19 at the time of transfer. For this reason, the visual image carried on the surface of the photoconductor drum 17 is transferred onto the sheet of paper 5 when the sheet of paper 5 passes through between the photoconductor drum 17 and the transfer roller 19.

The scanner portion 30 is provided in an upper portion in the body casing 4. The scanner portion 30 has a laser light source not shown, a polygon mirror 31 driven to rotate, an fθ lens 32, a reflection mirror 33, a lens 34, and a reflection mirror 35. A laser beam emitted from the laser light source on the basis of image data is deflected by the polygon mirror 31 as represented by the chain line in FIG. 2. After the laser beam passes through the fθ lens 32, an optical path is turned back by the reflection mirror 33. After the laser beam further passes through the lens 34, the optical path is bent down by the reflection mirror 35. In this manner, the laser beam is applied onto the surface of the photoconductor drum 17 of the process cartridge 14.

A fixing unit 37 for fixing the toner on the sheet of paper 5 is provided on the rear side of the process cartridge 14. The fixing unit 37 has a heat roller 38, and a pressure roller 39. The heat roller 38 is provided for heating the toner transferred onto the sheet of paper to melt the toner. The pressure roller 39 is disposed to be opposite to the heat roller 18 and provided for pressing the fed sheet of paper against the heat roller 38. In the fixing unit 37, the toner transferred onto the sheet of paper 5 in the transfer position is thermally fixed when the sheet of paper 5 passes through between the heat roller 38 and the pressure roller 39.

The sheet of paper 5 having the toner fixed is conveyed to a paper ejection path 41 which extends toward the upper surface of the body casing 4 while substantially curved like a "U" figure in sectional view. The sheet of paper 5 conveyed to the paper ejection path 41 is ejected onto a paper ejection tray 43 formed on the upper surface of the body casing 4, by a paper ejection roller 42 provided in the upper end position of the paper-ejection path 41. The paper ejection tray 43 is substantially provided in the widthwise center of the upper surface of the body casing 4 and has a paper loading surface 43A (upper surface of the paper ejection tray) shaped like a rectangle long in the front-rear direction. The paper loading surface 43A is inclined so that the height becomes high as the position becomes forward. The gradient of the paper loading surface 43A is relatively steep on the rear side and gentle on the front side. The paper ejection roller 42 is disposed above the rear end of the paper loading surface 43A. The sheet of paper 5 is ejected from the rear to the front by the paper ejection roller 42 and put on the paper loading surface 43A. The front end of the paper loading surface 43A extends to the upper surface of the front cover 15 which will be described later.

The cover body 3 (equivalent to the "document reading portion" in this invention) is formed in such a manner that an upper cover body 3A and a lower cover body 3B are piled vertically. The cover body 3 is put on the body casing 4 so that the whole upper surface of the body casing 4 is covered with the cover body 3.

An ADF 47 for conveying documents stacked on a document tray 45, making an image sensor 49 (which will be described later) read the documents and ejecting the read documents to an ejection tray 46 is provided at the left end of the upper cover body 3A. The document tray 45 protrudes like a plate to form a surface inclined obliquely upward from the ADF 47 to the right. Read documents ejected from the ADF 47 can be stacked and held on the upper portion of the document tray 45. Below the document tray 45, the ejection tray 46 is formed substantially horizontally in the right of the ADF 47 and on the whole width of the cover body 3 so that the read documents ejected from the ADF 47 can be stacked and held. The upper cover body 3A is formed so that the front end side of the upper cover body 3A can be opened/closed vertically around a pivot (not shown) provided in the rear end lower edge of the upper cover body 3A.

The lower cover body 3B has a transparent glass plate 48 provided as its upper surface. A document can be put on the glass plate 48 when the document needs to be read. The glass plate 48 is exposed when the upper cover body 3A is opened. An image sensor 49 for reading an image formed on the document as image data is provided in the inside (lower side) of the glass plate 48. An operation portion 50 provided with switches, buttons, etc. for operating the image forming apparatus 1 is provided in the front end portion of the lower cover body 3B. The lower cover body 3B is formed so that the front end side of the lower cover body 3B can be opened/closed vertically around a pivot (not shown) provided in the rear end lower edge of the lower cover body 3B. A gap S is provided between the bottom surface of the lower cover body 3B and the paper loading surface 43A of the paper ejection tray 43.

Next, the configuration of the front cover 15 and an extension tray 60 will be described in detail with reference to FIGS. 3 to 9. The front cover 15 (side cover) is provided as a side surface of the body casing 4 on the downstream side in the direction of ejection of the sheet of paper 5, that is, as a front surface of the body casing 4. The front cover 15 has a size covering a half or more of the upper side in the front surface of the body casing 4. The front cover 15 is substantially shaped like a rectangle in frontal view. A portion near the lower end of the front cover 15 is attached to the body casing 4 side by a mount pin 52. The front cover 15 is supported so that the front cover can rotate on the mount pin 52 as a pivot. Accordingly, when the front cover 15 is closed with the mount pin 52 as a center of rotation, the opening portion 16 in the front surface of the body casing 4 is blocked with the front cover 15 as represented by the solid line in FIG. 3. When the front cover 15 is turned by about 90° with the mount pin 52 as a pivot while the upper end portion of the front cover 15 is pulled out forward as represented by the two-dot chain line in FIG. 3, the opening portion 16 is opened so that the process cartridge 14 can be attached/detached to/from the body casing 4 through the opening portion 16.

A manual slit 53 piercing the front cover 15 in the front-rear direction is formed in the lower portion of the front cover 15 so as to be substantially located in the widthwise center. A sheet of paper manually inserted in the manual slit 53 can be conveyed to the registration rollers 11.

An inclined surface 54 is formed in the upper portion of the front cover 15. The inclined surface 54 is a region corresponding to the paper ejection tray 43 and inclined down to the front, that is, inclined down from the upstream side to the downstream side in the direction of ejection of the sheet of paper. The inclined surface 54 is formed in a region ranging from the downstream side end portion to the neighbor of the upstream side end portion in the upper surface of the front cover 15. A connection surface 55 inclined gently is formed in the upstream side end portion of the inclined surface 54 so that the connection surface 55 can be substantially connected smoothly to the paper loading surface 43A of the paper ejection tray 43 in the condition that the front cover 15 is closed.

A pair of left and right ribs 56 are provided on the inclined surface 54 so as to protrude along the front-rear direction in positions of about one third from widthwise opposite ends of the inclined surface 54. The upper end surface of each rib 56 is inclined down gently to the front. The upper end surface of each rib 56 is formed to have such a gradient that the rear end side of the rib 56 can be substantially connected smoothly to the paper loading surface 43A through the connection surface 55. As the position of the rib 56 goes forward, the size of protrusion of the rib 56 from the inclined surface 54 becomes so large that the gap between the sheet of paper 5 put in the upper end surface of the rib 56 and the inclined surface 54 becomes large. A rectangular recess 57 in which the extension tray 60 can be stored is provided in the widthwise center of the inclined surface 54. Incidentally, the pair of ribs 56 are disposed in widthwise opposite positions at a distance from the recess 57 so that the recess 57 is disposed between the pair of ribs 56. Incidentally, as shown in FIG. 2, the front end of the operation portion 50 of the lower cover body 3B and the front end surface of the front cover 15 are disposed in positions roughly coincident with each other in the front-rear direction. A paper ejection port 58 for taking out the ejected sheet of paper 5 is formed between the front end lower edge of the operation portion 50 and the front end of the inclined surface 54 of the front cover 15.

Figure 3:
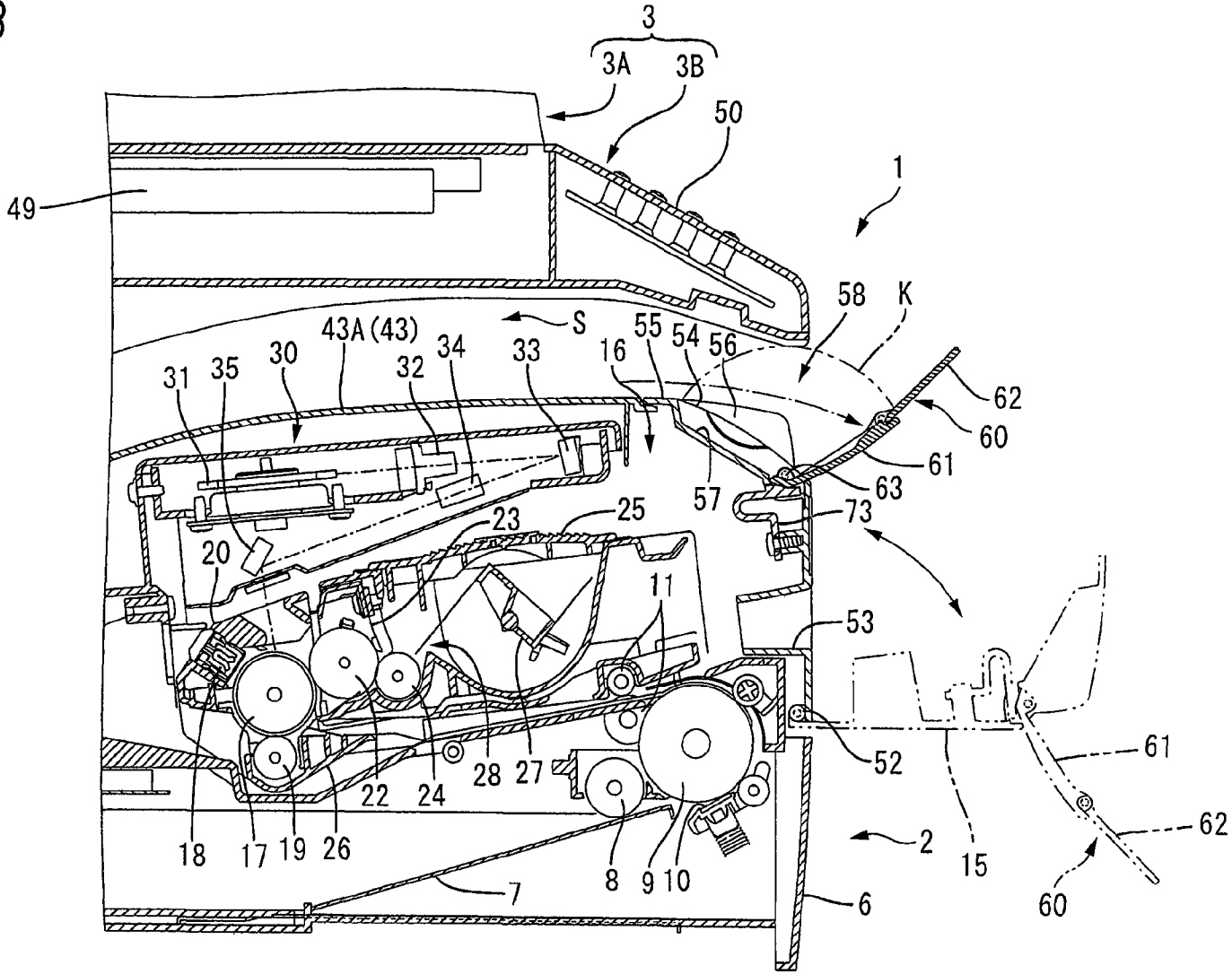
FIG. 3 is a partly enlarged side sectional view of the image forming apparatus.
Figure 6:
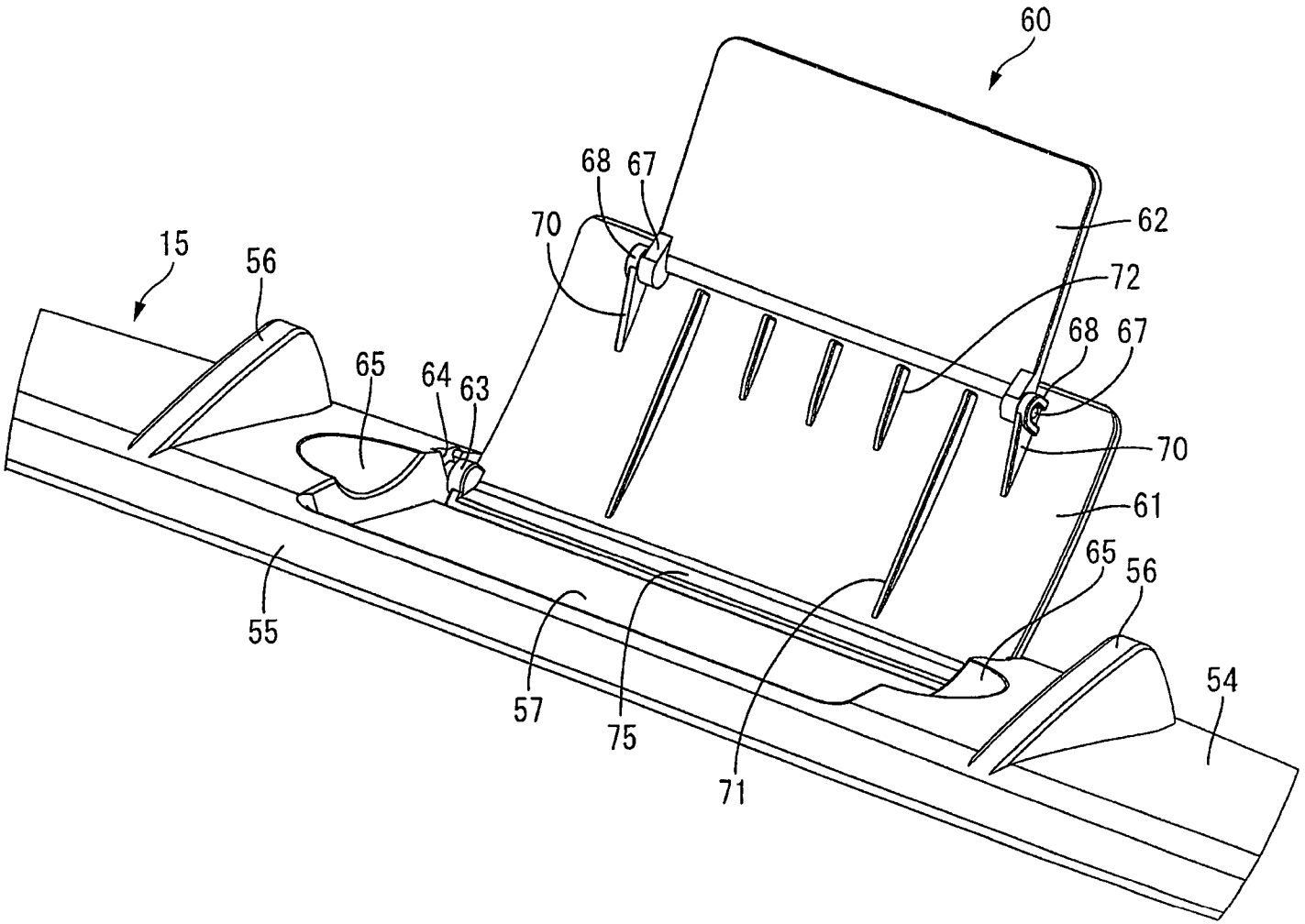
FIG. 6 is a perspective view showing a state in which the extension tray is unfolded.
Figure 7A:
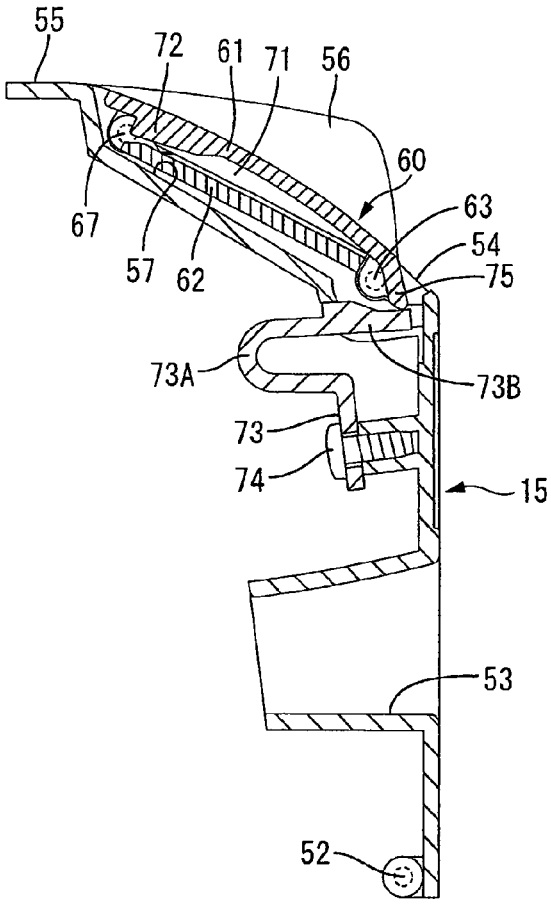
FIG. 7A is a sectional view showing a state in which the extension tray is stored.
Figure 7B:
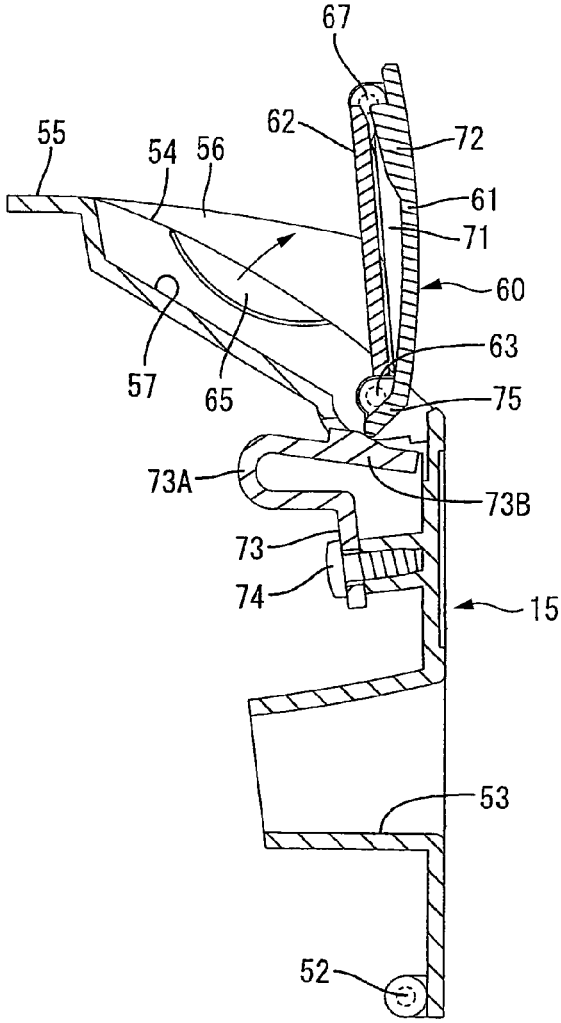
FIG. 7B is a sectional view showing a state in which the extension tray is being raised.
Figure 8:
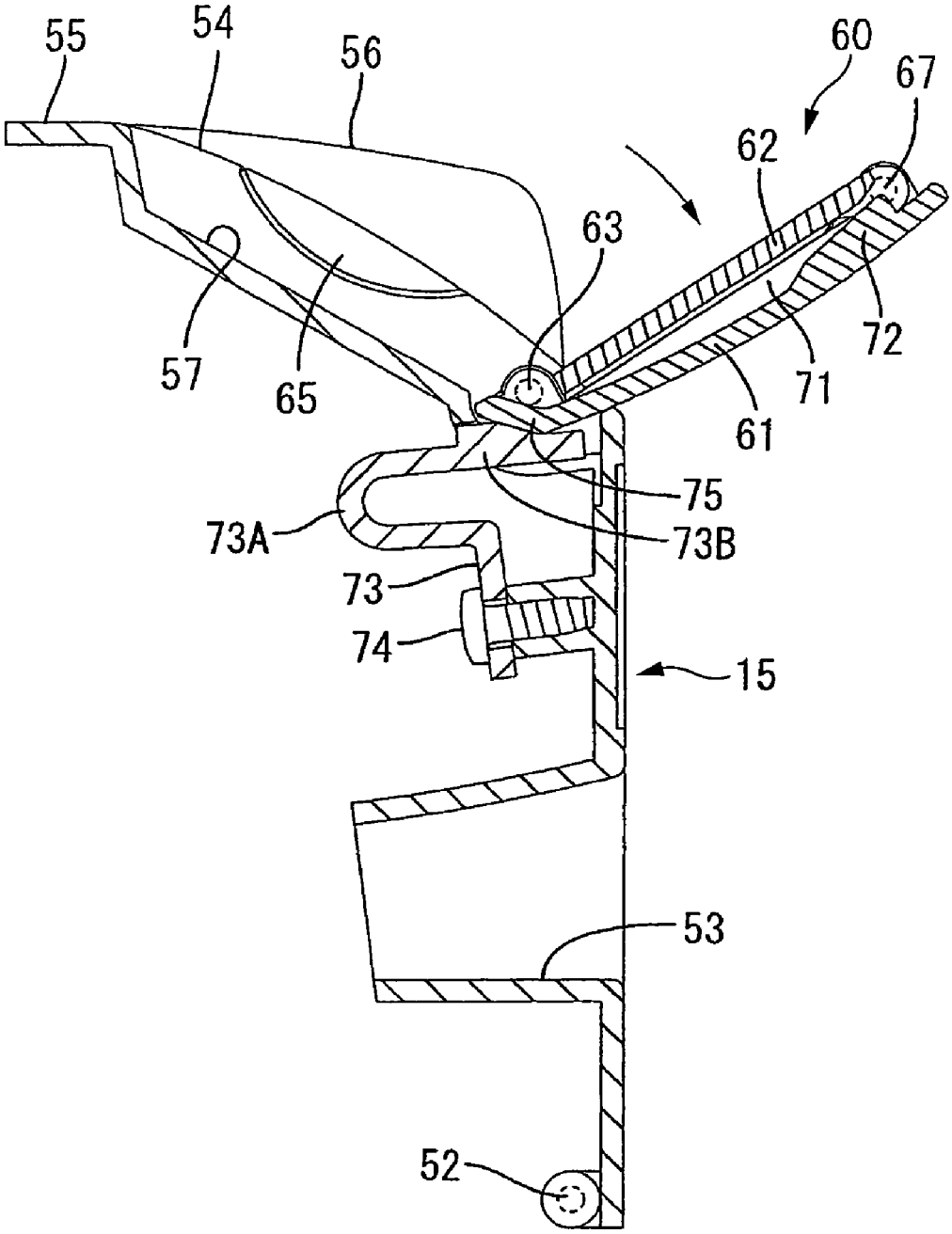
FIG. 8 is a sectional view showing a state in which the extension tray is pulled out.
Figure 9:
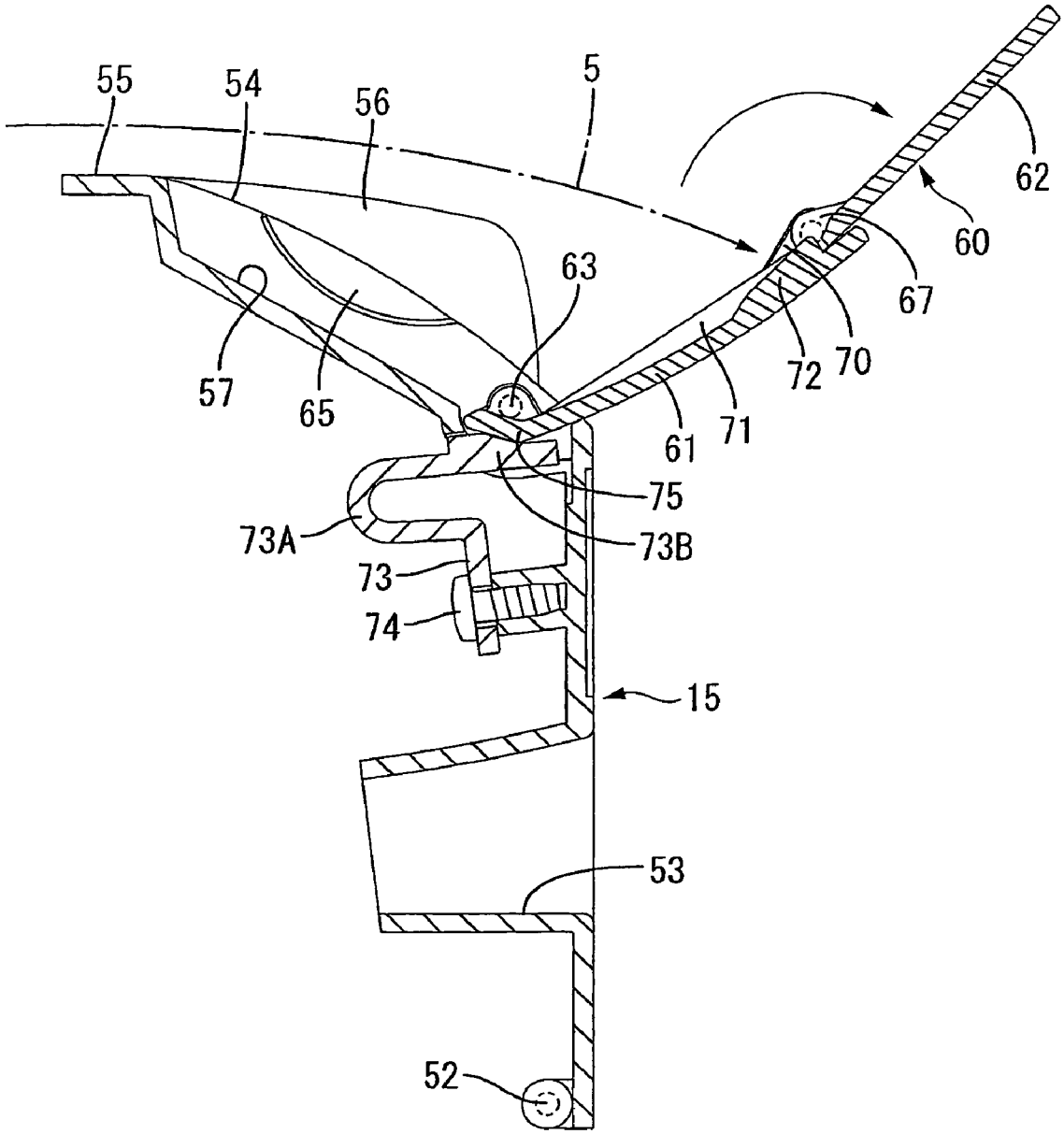
FIG. 9 is a sectional view showing a state in which the extension tray is unfolded.

As shown in FIGS. 6, 7A and 7B, the extension tray 60 has first and second support plates 61 and 62 (support members) each shaped like a plate. The first support plate 61 is shaped like a rectangle slightly smaller than the recess 57. The width of the first support plate 61 is larger than the length of the first support plate 61. A pair of left and right shaft portions 63 which protrude to widthwise opposite sides are provided on the lower end portion of the first support plate 61. When the two shaft portions 63 are fitted to bearing portions 64 concavely provided at front ends of left and right inner side surfaces of the recess 57, the first support plate 61 is held so that the first support plate 61 can rotate on the shaft portions 63 relative to the front cover 15. The shaft portions 63 are provided near the downstream side end portion of the upper surface of the front cover 15 in the direction of ejection of the sheet of paper, that is, the shaft portions 63 are disposed near the lower end of the paper ejection port 58. In FIG. 3, a locus of rotation of the front end of the first support plate 61 is represented by the chain line K. In this manner, the height of the paper ejection port 58 (the distance between the front end lower edge of the operation portion 50 and the front end of the inclined surface 54 of the front cover 15) is set to be slightly larger than the radius of rotation of the first support plate 61. When the first support plate 61 is rotated, the first support plate 61 can be displaced to a use position (see FIGS. 6 and 9) where the first support plate 61 extends obliquely upward to the downstream side in the direction of ejection of the sheet of paper and to a retraction position (see FIGS. 4 and 7A) where the first support plate 61 falls down to the upper surface side of the front cover 15. In the retraction position, the first support plate 61 is fitted into the recess 57 so that the outer surface of the first support plate 61 (the exterior surface in the retraction position) becomes on the same level with the inclined surface 54. Incidentally, caves 65 are provided in the upper surface of the front cover 15 and on left and right sides of the recess 57 so that the first support plate 61 can be easily pulled out from the retraction position to the use position.

The second support plate 62 is shaped like a rectangle having a width and a length (of each short side) both smaller than those of the first support plate 61. A pair of shaft portions 67 which protrude to widthwise opposite sides are provided at left and right ends of one lengthwise end portion of the second support plate 62. When the shaft portions 67 are fitted to a pair of bearing portions 68 which are provided so as to protrude to the free end sides in the inner surface (interior surface in the retraction position) of the first support plate 61, the second support plate 62 is supported so that the second support plate 62 can rotate relative to the first support plate 61. Accordingly, the second support plate 62 can be displaced to a position where the whole of the second support plate 62 overlaps with the inner surface of the first support plate 61 (the state of the two support plates 61 and 62 in this case is referred to as "folded state", see FIGS. 5 and 7A) and to a position where the second support plate 62 extends from the free end of the first support plate 61 to a side opposite to the shaft portions 63 (the state of the two support plates 61 and 62 in this case is referred to as "unfolded state", see FIGS. 6 and 9). When the two support plates 61 and 62 are folded, the first support plate 61 can be rotated in the front-rear direction without interference of the second support plate 62 with the operation portion 50. When the two support plates 61 and 62 are folded, the two support plates 61 and 62 can be stored in the recess 57.

A pair of left and right hang-up prevention ribs 70 which extend from the lengthwise center to the bearing portions 68 respectively are provided on the inner surface of the first support plate 61. Upper end surfaces of the hang-up prevention ribs 70 are inclined so that the height of the upper end surfaces becomes high gradually up to the upper ends of the bearing portions 68 from the upstream side (the side of the shaft portions 63) in the direction of conveyance of the sheet of paper to the downstream side. A pair of left and right large ribs 71 and three small ribs 72 shown in FIG. 6 are provided on the inner surface of the first support plate 61. The two large ribs 71 extend on the roughly whole region in the lengthwise direction. The three small ribs 72 are disposed between the two large ribs 71 and extend from the lengthwise center to the downstream side. Upper end surfaces of the ribs 71 and 72 are inclined so that the height of the upper end surfaces becomes high from the upstream side to the downstream side. When the end portion of the sheet of paper 5 comes into frictional contact with the extension tray 60, these ribs 70, 71 and 72 can help the end portion of the sheet of paper 5 to move from the first support plate 61 to the second support plate 62 smoothly.

A pair of left and right spring members 73 (stopper) are attached to the inner surface of the front cover 15 so that the spring members 73 are located under the recess 57. Each of the spring members 73 is formed in such a manner that a plate material made of a synthetic resin is bent. A lower end portion of each spring member 73 is fixed to the front cover 15 by a screw 74. A flexible portion 73A substantially shaped like a "U" figure in sectional view is provided in the upper portion of each spring member 73. A front end portion of the flexible portion 73A can be flexibly deformed vertically. A stopper portion 73B is provided in the front end portion of the flexible portion 73A. An upper surface of the stopper portion 73B has such a shape that a portion slightly far from the front end protrudes stepwise. On the other hand, a stopped portion 75 (stopper) having end portions bent slightly inward is formed in the lower end portion of the first support plate 61 and near the axial line of the pair of shaft portions 63. The stopper portions 73B of the spring members 73 are always pressed against the stopped portion 75 by the elasticity of the flexible portions 73A. When the first support plate 61 is moved to the retraction position or to the use position, the stopper portions 73B are fitted to the stopped portion 75 to thereby hold the first support plate 61 relative to the front cover 15.

Figure 4:
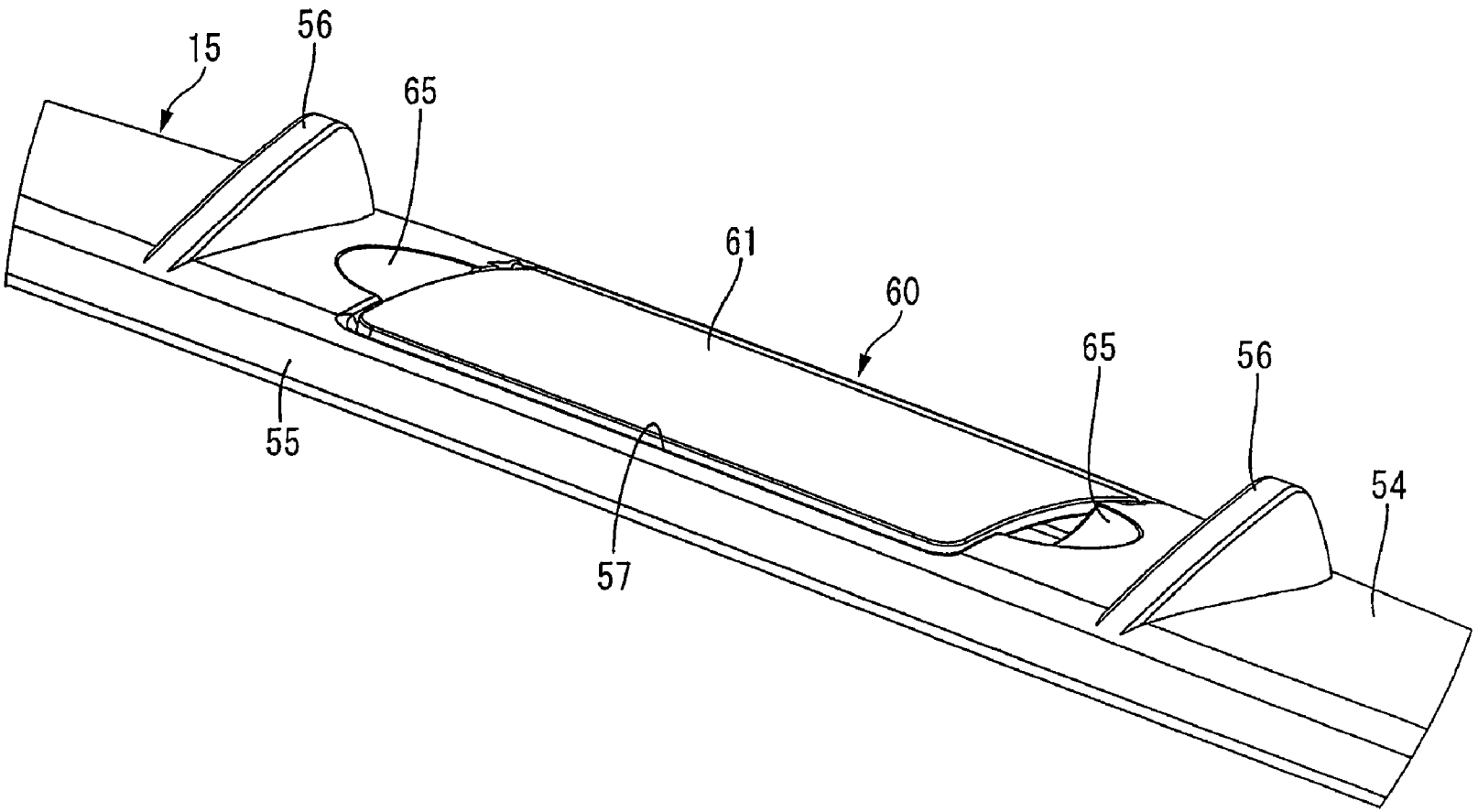
FIG. 4 is a perspective view showing a state in which an extension tray is stored.
Figure 5:
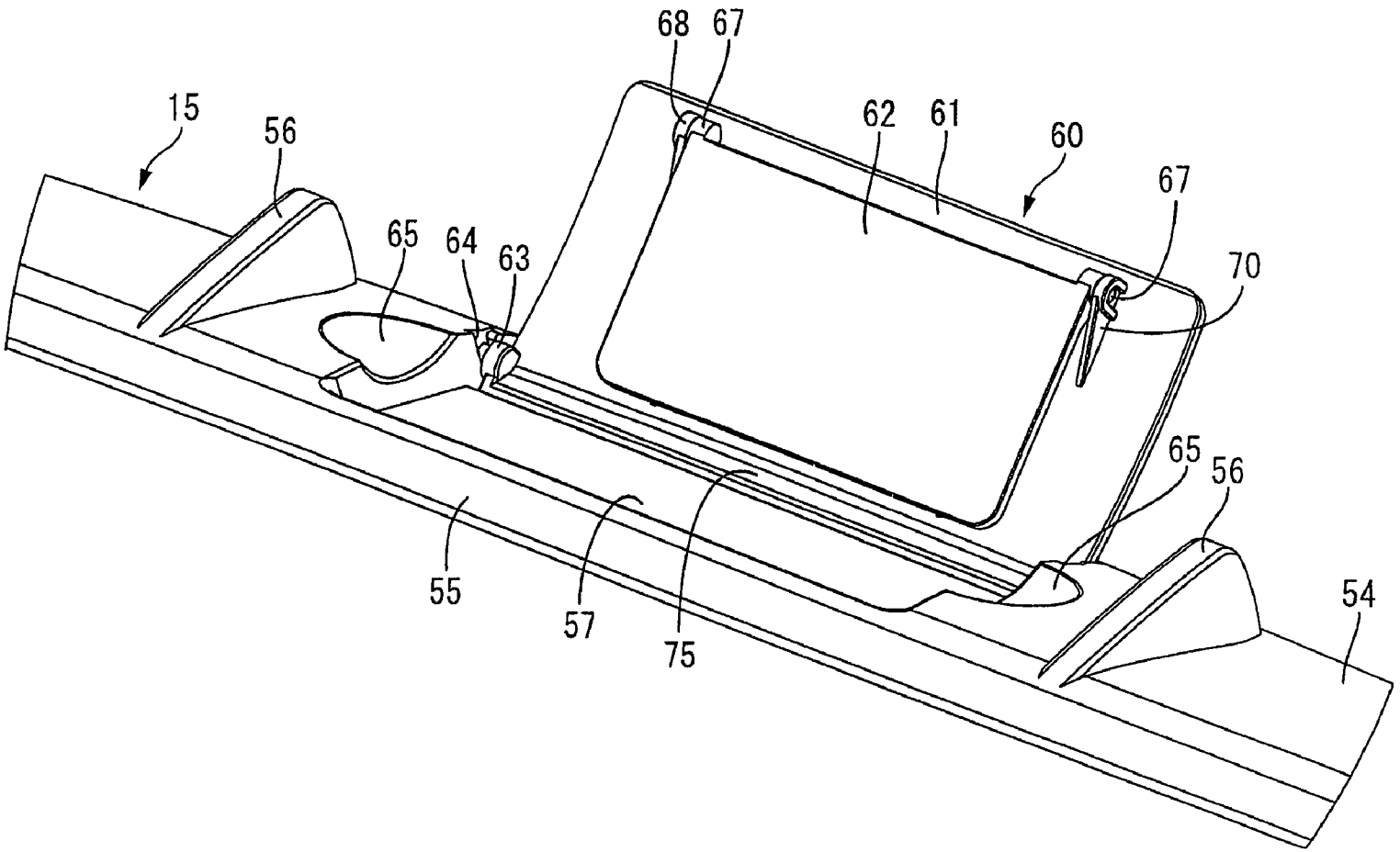
FIG. 5 is a perspective view showing a state in which the extension tray is pulled out.

Next, the operation and effect of this embodiment will be described. For formation of an image on a large-size sheet of paper 5, the extension tray 60 is used. In the condition that the extension tray 60 folded is stored in the recess 57, the stopped portion 75 of the first support plate 61 is erected as shown in FIGS. 4 and 7A. The stopper portions 73B of the spring members 73 are pressed against the front end of the stopped portion 75 of the first support plate 61 by the elasticity of the flexible portions 73A and fitted to the stopped portion 75.

This state can be changed to a usable state of the extension tray 60 as follows. First, the first support plate 61 is raised forward while the side end of the first support plate 61 is hooked with a finger inserted in one of the caves 65 (see FIG. 7B). With this, the stopped portion 75 of the first support plate 61 slightly moves down to press the stopper portions 73B. As a result, the front ends of the flexible portions 73A are flexibly deformed downward.

When the upper end portion of the first support plate 61 is pulled down to the front, the stopped portion 75 is laid down. The stopper portions 73B are fitted to the lower surface of the stopped portion 75 by the upward restoring deformation of the flexible portions 73A (see FIGS. 5 and 8). Accordingly, the first support plate 61 is kept in the use position. When the second support plate 62 is then raised up and rotated by about 180°, the two support plates 61 and 62 are unfolded (see FIGS. 6 and 9) so that the extension tray 60 can be used.

The aforementioned operation can be made easily because the extension tray 60 is initially provided on the upper surface of the front cover 15 and near the paper ejection port 58. Moreover, because the inclined surface 54 inclined down to the front is provided in the upper surface of the front cover 15, the paper ejection port 58 is enlarged vertically so that the operation can be made easily.

When the front end of the sheet of paper 5 ejected from the paper ejection roller 42 onto the paper ejection tray 43 passes through the paper loading surface 43A, the front end of the sheet of paper 5 reaches the ribs 56 through the connection surface 55. In a case where the front end of the sheet of paper 5 is stopped on the ribs 56, a finger can be inserted in the gap formed between the inclined surface 54 and the sheet of paper 5 to pick out the sheet of paper 5. In this case, the sheet of paper 5 can be taken out easily because the gap between each rib 56 and the extension tray 60 prevents the portion of the front end of the sheet of paper 5 lifted up by the ribs 56 from hiding behind the extension tray 60. In a case where the front end of the sheet of paper 5 skips over the ribs 56 to the outside of the paper ejection port 58, the sheet of paper 5 is restrained from moving any more to the downstream side while the end portion of the sheet of paper 5 is supported because the front end of the sheet of paper 5 abuts on the extension tray 60 (the inner surface of the first support plate 61 or the inner surface of the second support plate 62) (see FIG. 9).

Attachment/detachment of the process cartridge 14, treatment against jamming, or the like, can be performed as follows. As represented by the two-dot chain line in FIG. 3, the upper end portion of the front cover 15 is pulled down to the front so that the opening portion 16 in the front surface of the body casing 4 is opened. On this occasion, the position of the extension tray 60 does not change before and after the front cover 15 is opened/closed because the extension tray 60 is stopped and retained by the spring members 73 regardless of whether the first support plate 61 of the extension tray 60 is located in the use position or in the retraction position.

As described above, in accordance with the embodiment, the extension tray 60 is attached to the front cover 15 which covers the side surface of the body casing 4 on the downstream side in the direction of ejection of the sheet of paper so that the front cover 15 can be opened/closed. Accordingly, reduction in cost can be attained because the length of the extension tray can be reduced compared with the case where the extension tray is provided on the body casing 4 side.

Moreover, because the upper end surfaces of the ribs 56 provided on the upper surface of the front cover 15 are formed to be substantially smoothly connected to the paper loading surface 43A of the paper ejection tray 43, the front end portion of the sheet of paper 5 ejected onto the paper ejection tray 43 can be put on the ribs 56 so that the sheet of paper 5 can be taken out easily.

Moreover, because the pair of ribs 56 provided on widthwise opposite sides with respect to the extension tray 60 are disposed at a distance from the extension tray 60, the sheet of paper 5 can be taken out easily without any obstruction caused by the extension tray 60 when the sheet of paper 5 having the front end portion put on the ribs 56 needs to be taken out.

Moreover, because the inclined surface 54 inclined down from the upstream side to the downstream side is formed in the end portion of the upper surface of the front cover 15 on the downstream side in the direction of ejection of the sheet of paper, the front end of the sheet of paper 5 floats up from the inclined surface 54 so that the sheet of paper 5 can be taken out easily when the front end of the sheet of paper 5 is put on the front cover 15.

Moreover, because the extension tray 60 can be rotated on the shaft portions 63 provided on the upper surface of the front cover 15 and near the downstream side end portion in the direction of ejection of the sheet of paper, the length of the extension tray 60 can be reduced greatly without change of the maximum paper size allowed to be loaded.

Moreover, because the extension tray 60 can be held in the use position or in the retraction position by the stopper (the spring members 73 and the stopped portion 75) provided between the front cover 15 and the extension tray 60, the front cover 15 can be opened/closed, for example, while the position of the extension tray 60 is kept as it is.

Moreover, because the extension tray 60 has a pair of substantially plate-like support plates 61 and 62 rotatably connected to each other so that the two support plates 61 and 62 can be displaced so as to be unfolded/folded, the extension tray 60 can be folded compactly when the extension tray 60 is not used. In this embodiment, because the extension tray 60 can be rotated to the use position or to the retraction position while folded, it is unnecessary to provide a large space for avoiding interference with the extension tray 60. Accordingly, reduction in size of the apparatus as a whole can be attained.

Moreover, in the image forming apparatus having the document reading portion put on the body casing, increase in size of the apparatus is caused by the fact that it may be necessary to provide a large gap between the paper ejection tray and the document reading portion in order to avoid the interference of the document reading portion with the extension tray when a rotary extension tray is attached to the upper surface of the body casing. On the contrary, in this embodiment, the size of the extension tray 60 can be reduced because the extension tray 60 is attached to the front cover 15. Accordingly, the gap S between the paper ejection tray 43 and the document reading portion (cover body 3) can be reduced so that reduction in size of the apparatus can be attained.

Moreover, because the front cover 15 is formed so that the upper end side of the front cover 15 can be opened/closed around the shaft provided on the lower end side of the front cover 15, the process cartridge 14 can be attached/detached easily.

OTHER EMBODIMENTS

The invention is not limited to the embodiment explained in the aforementioned description and the drawings. For example, the following embodiments may be included in the technical scope of the invention and various changes other than the following embodiments may be made without departing from the gist of the invention.

(1) Although the aforementioned embodiment has been described on the case where the extension tray is stored in the recess provided in the upper surface of the side cover when the extension tray is not used, the embodiments may be applied to the case where the extension tray is provided so that the extension tray can be attached/detached to/from the side cover so that the extension tray can be removed when the extension tray is not used.

(2) Although the aforementioned embodiment has been described on the case where the invention is applied to a multi-functional image forming apparatus, the embodiments may be applied to another kind of image forming apparatus such as an ink-jet printer.

(3) Although the aforementioned embodiment has been described on the case where the extension tray is provided on the front cover on the front side of the apparatus (on a side where the operation portion is provided), the embodiments may be applied to the case where the extension tray is provided on the side cover which is provided on the downstream side in the direction of ejection of the sheet of paper so that the side cover can be opened/closed when the sheet of paper is ejected in the left-right direction.

What is claimed is:

1. An image-forming apparatus comprising:

an image forming unit that is configured to form an image on a sheet;

a body casing including a top board that is disposed above the image forming unit, side boards, each of which is disposed on a side of the image forming unit, and a bottom board that is disposed below the image forming unit;

a paper ejection tray formed as part of an upper surface of the top board, the paper ejection tray being configured to receive a sheet of paper ejected after formation of an image, the paper being ejected in a downstream direction;

a side cover attached to one of the side boards of the body casing on the downstream side in the direction of ejection of the sheet of paper so as to cover one of the side boards of the body casing, said side cover configured to open and close; and an extension tray being attached to an upper portion of the side cover, and the extension tray capable of extending to the downstream side in the direction of ejection of the sheet of paper with respect to the paper ejection tray so as to support an end portion of the sheet of paper, wherein the extension tray is capable of rotating on a rotation shaft provided near an end portion of upper surface of the side cover on a downstream side in a direction of ejection of the sheet of paper, wherein the extension tray is operable to be displaced to at least two positions, wherein a document reading portion reading an image on a document is put on the body casing in a condition that a gap is formed between the document reading portion and the upper surface of the top board, wherein the body casing stores a process cartridge having an image carrier, wherein the side cover is formed so that an upper end side of the side cover can be opened/closed around a shaft provided on a lower end side of the side cover, and wherein the process cartridge can be attached/detached through an opening portion which is formed by opening the side cover.

2. An image-forming apparatus according to claim 1, further comprising:

a rib being on upper surface of the side cover, the rib protruding along the direction of ejection of the sheet of paper, the rib having upper end surface which is substantially smoothly connected to an upper surface of the top board.

3. An image-forming apparatus according to claim 2, wherein the rib has at least one pair of ribs on both sides in the widthwise direction of the extension tray, and wherein at least one pair of ribs is disposed to be spatially separated from the extension tray.

4. An image-forming apparatus according claim 1, wherein an inclined surface is formed on an end portion of upper surface of the side cover on a downstream side in a direction of ejection of the sheet of paper, and wherein the inclined surface is inclined down from the upstream side to the downstream side in a direction of ejection of the sheet of paper.

5. The image-forming apparatus according to claim 1, wherein a first position of at least two positions is a use position where the extension tray extends to the downstream side in the direction of ejection of the sheet of paper, and wherein a second position of at least two positions is a retraction position where the extension tray falls down to upper surface side of the side cover when the extension tray is rotated.

6. An image-forming apparatus according to claim 1, wherein a stopper is provided between the side cover and the extension tray so that the extension tray can be kept in a use position or in a retraction position when a stopper is fitted to each other.

7. An image-forming apparatus according to claim 5, wherein the extension tray has at least one pair of substantially plate-like support members which is rotatably connected to each other, and wherein at least one pair of substantially plate-like support members can be displaced to be unfolded/folded.

8. An image-forming apparatus according to claim 2, wherein the rib has at least one pair of ribs on both sides in the widthwise direction of the extension tray, wherein an inclined surface is formed on an end portion of upper surface of the side cover on a downstream side in a direction of ejection of the sheet of paper, wherein the inclined surface is inclined down from the upstream side to the downstream side in a direction of ejection of the sheet of paper, and wherein at least one pair is disposed on the inclined surface to be spatially separated from the extension tray.

9. An image-forming apparatus according to claim 1, wherein the extension tray does not overlap with the side cover when the side cover is closed.

10. An image-forming apparatus comprising:

an image forming unit that is configured to form an image on a sheet;

a body casing including a top board that is disposed above the image forming unit, side boards, each of which is disposed on a side of the image forming unit, and a bottom board that is disposed below the image forming unit;

a paper ejection tray formed as part of an upper surface of the top board, the paper ejection tray configured to receive a sheet of paper ejected after formation of an image, the paper being ejected in a downstream direction;

a side cover attached to one of the side boards of the body casing on the downstream side in the direction of ejection of the sheet of paper so as to cover one of the side boards of the body casing, said side cover configured to open and close; and an extension tray being attached to an upper portion of the side cover, and the extension tray capable of extending to the downstream side in the direction of ejection of the sheet of paper with respect to the paper ejection tray so, as to support an end portion of the sheet of paper, wherein the extension tray is operable to be stored on an inclined surface formed in the upper portion of the side cover, wherein the inclined surface is inclined down from the upstream side to the downstream side in a direction of ejection of the sheet of paper, wherein the body casing stores a process cartridge having an image carrier, wherein the side cover is formed so that an upper end side of the side cover can be opened/closed around a shaft provided on a lower end side of the side cover, and wherein the process cartridge can be attached/detached through an opening portion which is formed by opening the side cover.

11. An image-forming apparatus according to claim 10, wherein the extension tray has at least one pair of substantially plate-like support members which is rotatably connected to each other, and wherein at least one pair of substantially plate-like support members can be displaced to be unfolded/folded.

12. An image-forming apparatus according to claim 11, wherein the extension tray is stored in a folded state in a recess of the inclined surface.

13. An image-forming apparatus comprising:

an image forming unit that is configured to form an image on a sheet;

a body casing including a top board that is disposed above the image forming unit, side boards, each of which is disposed on a side of the image forming unit, and a bottom board that is disposed below the image forming unit;

a paper ejection tray formed as part of an upper surface of the top board, the paper ejection tray being configured to receive a sheet of paper ejected after formation of an image, the paper being ejected in a downstream direction;

a side cover attached to one of the side boards of the body casing on the downstream side in the direction of ejection of the sheet of paper so as to cover one of the side boards of the body casing, said side cover configured to open and close; and an extension tray being attached to an upper portion of the side cover, and the extension tray capable of extending to the downstream side in the direction of ejection of the sheet of paper with respect to the paper ejection tray so as to support an end portion of the sheet of paper, wherein the extension tray is capable of rotating on a rotation shaft provided near an end portion of upper surface of the side cover on a downstream side in a direction of ejection of the sheet of paper, wherein the extension tray is operable to be displaced to at least two positions, wherein the body casing stores a process cartridge having an image carrier, wherein the side cover is formed so that an upper end side of the side cover can be opened/closed around a shaft provided on a lower end side of the side cover, and wherein the process cartridge can be attached/detached through an opening portion which is formed by opening the side cover.

14. An image-forming apparatus according to claim 13, further comprising:

a rib being on upper surface of the side cover, the rib protruding along the direction of ejection of the sheet of paper, the rib having upper end surface which is substantially smoothly connected to an upper surface of the top board.

15. An image-forming apparatus according to claim 14, wherein the rib has at least one pair of ribs on both sides in the widthwise direction of the extension tray, and wherein at least one pair of ribs is disposed to be spatially separated from the extension tray.

16. An image-forming apparatus according claim 14, wherein an inclined surface is formed on an end portion of upper surface of the side cover on a downstream side in a direction of ejection of the sheet of paper, and wherein the inclined surface is inclined down from the upstream side to the downstream side in a direction of ejection of the sheet of paper.

17. The image-forming apparatus according to claim 13, wherein a first position of at least two positions is a use position where the extension tray extends to the downstream side in the direction of ejection of the sheet of paper, and wherein a second position of at least two positions is a retraction position where the extension tray falls down to upper surface side of the side cover when the extension tray is rotated.

18. An image-forming apparatus according to claim 13, wherein a stopper is provided between the side cover and the extension tray so that the extension tray can be kept in a use position or in a retraction position when a stopper is fitted to each other.

19. An image-forming apparatus according to claim 17, wherein the extension tray has at least one pair of substantially plate-like support members which is rotatably connected to each other, and wherein at least one pair of substantially plate-like support members can be displaced to be unfolded/folded.

* * * * *